US008070412B2

(12) United States Patent
Shioji et al.

(10) Patent No.: US 8,070,412 B2
(45) Date of Patent: Dec. 6, 2011

(54) WHEEL LOADER

(75) Inventors: Hiroyuki Shioji, Hirakata (JP); Akira Matsue, Komatsu (JP)

(73) Assignees: Komatsu Ltd., Tokyo (JP); Komatsu Utility Co., Ltd., Tokyo (JP)

( * ) Notice: Subject to any disclaimer, the term of this patent is extended or adjusted under 35 U.S.C. 154(b) by 180 days.

(21) Appl. No.: 12/516,072

(22) PCT Filed: Nov. 22, 2007

(86) PCT No.: PCT/JP2007/072660

§ 371 (c)(1),
(2), (4) Date: May 22, 2009

(87) PCT Pub. No.: WO2008/062868

PCT Pub. Date: May 29, 2008

(65) Prior Publication Data

US 2010/0098522 A1 Apr. 22, 2010

(30) Foreign Application Priority Data

Nov. 24, 2006 (JP) ..... 2006-317278

(51) Int. Cl.
*E02F 3/627* (2006.01)

(52) U.S. Cl. ..... 414/686; 37/456; 172/275

(58) Field of Classification Search ..... 414/685, 414/686; 172/811–817, 272–275; 37/264, 37/266, 456; 403/336, 335
See application file for complete search history.

(56) References Cited

U.S. PATENT DOCUMENTS

| | | | | |
|---|---|---|---|---|
| 3,604,527 | A | 9/1971 | Price | |
| 4,182,456 | A | 1/1980 | Paul | |
| 5,535,533 | A | 7/1996 | Romanchok | |
| 6,799,936 | B2 * | 10/2004 | Sprinkle | 414/686 |
| 7,530,779 | B2 * | 5/2009 | Holloway et al. | 414/686 |
| 7,559,250 | B2 | 7/2009 | Seitz et al. | |
| 7,757,805 | B2 | 7/2010 | Wakuta et al. | |

(Continued)

FOREIGN PATENT DOCUMENTS

EP 0 833 012 A1 4/1998

(Continued)

OTHER PUBLICATIONS

English Language International Search Report dated Jan. 15, 2008 issued in parent Appln. No. PCT/JP2007/072660.

(Continued)

*Primary Examiner* — Donald Underwood
(74) *Attorney, Agent, or Firm* — Holtz, Holtz, Goodman & Chick, P.C.

(57) ABSTRACT

A wheel loader includes a bucket boom including a pair of left and right side members; a front frame to which the base ends of the pair of side members are coupled; and a boom cylinder of which a base end is coupled to the front frame and a distal end is coupled to the side members. A base-end interval between the pair of side members is smaller than a distal-end interval between the side members. A face section that inclines towards a middle as extending in an upwards direction is provided on the left and right extremities of the front frame. A mounting boss to which the base end of the boom cylinder is attached is provided on a lower side of the face section while a mounting boss to which the base ends of the side members are attached is provided on an upper side of the face section.

4 Claims, 6 Drawing Sheets

U.S. PATENT DOCUMENTS

| | | | |
|---|---|---|---|
| 7,775,556 | B2 | 8/2010 | Sakamoto et al. |
| 7,832,519 | B2 | 11/2010 | Sakamoto et al. |
| 7,866,700 | B2 | 1/2011 | Weibling et al. |
| 2004/0239092 | A1 | 12/2004 | Haringer |
| 2005/0045351 | A1 | 3/2005 | O'Brien et al. |
| 2005/0167969 | A1 | 8/2005 | Fukazawa et al. |
| 2006/0001250 | A1 | 1/2006 | Fukazawa et al. |
| 2007/0056786 | A1 | 3/2007 | Fukazawa et al. |
| 2007/0145780 | A1 | 6/2007 | Tecklenburg et al. |
| 2008/0035404 | A1 | 2/2008 | Dahl et al. |
| 2010/0320807 | A1 | 12/2010 | Shioji et al. |

FOREIGN PATENT DOCUMENTS

| | | | |
|---|---|---|---|
| JP | 1-152881 | U | 10/1989 |
| JP | 8-199619 | A | 8/1996 |
| JP | 10-114958 | A | 5/1998 |
| JP | 2003-184122 | A | 7/2003 |
| JP | 2004-276881 | A | 10/2004 |
| JP | 2005-68993 | A | 3/2005 |
| JP | 3730291 | B2 | 10/2005 |
| JP | 2006-168612 | A | 6/2006 |
| WO | WO 2006/098084 | A1 | 9/2006 |

OTHER PUBLICATIONS

International Preliminary Report on Patentability and Written Opinion of the International Searching Authority dated May 26, 2009 (5 pages), issued in counterpart International application No. PCT/JP2007/072660.

* cited by examiner

WHEEL LOADER

This application is a U.S. National Phase Application under 35 USC 371 of International Application PCT/JP2007/072660 filed Nov. 22, 2007.

TECHNICAL FIELD

The present invention relates to a wheel loader, and in particular to the structure of a front frame provided on a comparatively small wheel loader.

BACKGROUND ART

To date, in order to improve visibility from the driver's seat in a wheel loader, improvements in the shape of a bucket boom (also called a lift arm or lift link) included in a working equipment have been proposed (see patent documents 1 and 2). Specifically, a bucket attached to the front of such a working equipment, especially its left and right ends, is designed to be easily visible from the driver's seat, so that the position of the bucket with respect to the dump vessel can be quickly determined when loading soil into a dump, whereby operation(s) can be favorably carried out.

Specifically, according to the patent document 1, a bucket boom including a pair of left and right members is designed such that base ends of the members are coupled to a front frame while their distal ends are coupled to the bucket. By designing an interval between the members at their base ends to be smaller than an interval at their distal ends, a link mechanism is arranged not to widely spread out to the left and right at a side adjacent the front frame, thereby improving visibility.

On the other hand, according to the patent document 2, while the base ends and distal ends of the left and right members are respectively coupled to the front frame and the bucket, the interval between the distal ends of the members and the interval between their base ends are designed to be substantially equal. However, the interval between the members is narrowed in substantially the middle of each of the members in the front-rear direction, whereby visibility is improved. In other words, while a traditional arrangement is designed such that crossmembers connecting the members at their middles are positioned at the exact height of the dump vessel when the bucket boom is raised (lifted up) and thus blocks the bucket located to the front, the arrangement according to the patent document 2 is designed such that, by reducing the interval between the members at their middles, the left and right ends of the bucket can be reliably seen from the driver's seat even when the bucket is raised.

Patent Document 1: Japanese Patent No. 3730291

Patent Document 2: JP-A-2003-184122

DISCLOSURE OF THE INVENTION

Problems to Be Solved by the Invention

However, the wheel loaders disclosed in the patent documents 1 and 2, which are both of a comparatively large type, have their respective driver's seats at high positions. In such wheel loaders, what obstruct the field of vision from the high-positioned driver's seat are the link mechanism arranged on an upper part of the bucket boom (in the patent document 1) and the crossmembers of the raised bucket boom (in the patent document 2). Both the patent documents 1 and 2 only propose improvement(s) in visibility in those particular circumstances.

Accordingly, when the driver's seat is not positioned so high and a mounting portion for mounting the bucket boom to the front frame is located near the driver's seat as in a comparatively small wheel loader, the mounting portion for mounting the bucket boom to the front frame accounts for a greater percentage of the operator's field of vision than a counterpart in a large wheel loader. Thus, it has as of yet proved difficult to ensure a favorable field of view merely by improving the shape of the bucket boom, and a solution to such a problem has been desired.

An object of the present invention is to provide a wheel loader capable of ensuring a favorable forward visibility even when a driver's seat is not positioned so high.

Means for Solving the Problems

A wheel loader according to an aspect of the present invention includes: a bucket boom including a pair of left and right side members; a front frame to which base ends of the pair of side members are coupled; and a boom cylinder of which a base end is coupled to the front frame and a distal end is coupled to the side members, in which an interval between the pair of side members at their base ends is smaller than an interval at their distal ends, a face section that inclines towards a middle (inclines inward) as extending in an upwards direction is provided on left and right extremities of the front frame, a mounting boss to which the base end of the boom cylinder is attached is provided on a lower side of the face section, and a mounting boss to which the base ends of the side members are attached is provided on an upper side of the face section.

According to the aspect of the present invention, the face section that inclines inward as extending in the upwards direction is provided on the left and right extremities of the front frame, and the boom cylinder and the bucket boom are coupled respectively to the lower and upper sides of this face section. With this arrangement, not only the interval between the base ends of the side members included in the bucket boom is made narrow, but also the inclined face section reduces a width in the left and right directions on the upper side of the front frame to which the base ends of the side members are coupled. Thus, a forward visibility from the driver's seat through both the left and right sides of the front frame can be made favorable, so that a position of an attachment such as a bucket can be easily observed.

In the wheel loader according to the aspect of the present invention, the face section is provided on a pair of left and right side panels that the front frame includes, and the side panels are wholly inclined in the same direction as the face section.

According to the aspect of the present invention, since the side panels are wholly inclined, a wide lower-region interval between the left and right side panels, i.e., bottom side of the front frame, can be ensured. Thus, when the front frame is shaped in, for instance, a box, an interior space can be made large and equipments such as control valves can be arranged easily.

In the wheel loader according to the aspect of the present invention, a folded section that is vertically folded to have a substantially U-shaped cross-section is provided on the side panels, and the mounting boss for the boom cylinder and the mounting boss for the side members are provided on each of a first face section that forms an outer side of the folded section and a second face section opposed to and located interior to the first face section such that the mounting bosses are vertically spaced apart from each other.

According to the aspect of the present invention, since the folded section where each mounting boss is provided is formed to have a vertically-continuous substantially U-shaped cross-section, sufficient rigidity can be secured for the folded section. In addition, since the folded section is formed through folding, the folded section is easy to manufacture.

In the wheel loader according to the aspect of the present invention, the mounting boss is provided with a through-hole that allows a coupling pin to pass through, an axial center of the through-hole is de-centered with respect to an axial center of the mounting boss, and a bolt hole into which a bolt for fastening the coupling pin is bolted is provided in a thick section of the mounting boss, the thick section being provided by the de-centering.

When the bolt hole for stopping the coupling pin from falling out is formed at a position located apart from the mounting boss, it is necessary to separately provide a boss dedicated to that bolt hole. However, because such a boss is required to be provided on the top of the inclined face section, the shape thereof may become complex and accurate positioning would also be required, which would take more time and labor for manufacture and mounting.

In contrast, according to the aspect of the present invention, the through-hole for the coupling pin is provided de-centered with respect to the axial center of the already-existing mounting boss, and the bolt hole is provided in the thick section formed therewith. Thus, the forming of the bolt hole does not require a dedicated boss, which not only can reduce the number of parts but also do away with a mounting operation for mounting such a dedicated boss.

BEST MODE FOR CARRYING OUT THE INVENTION

Figure 1:
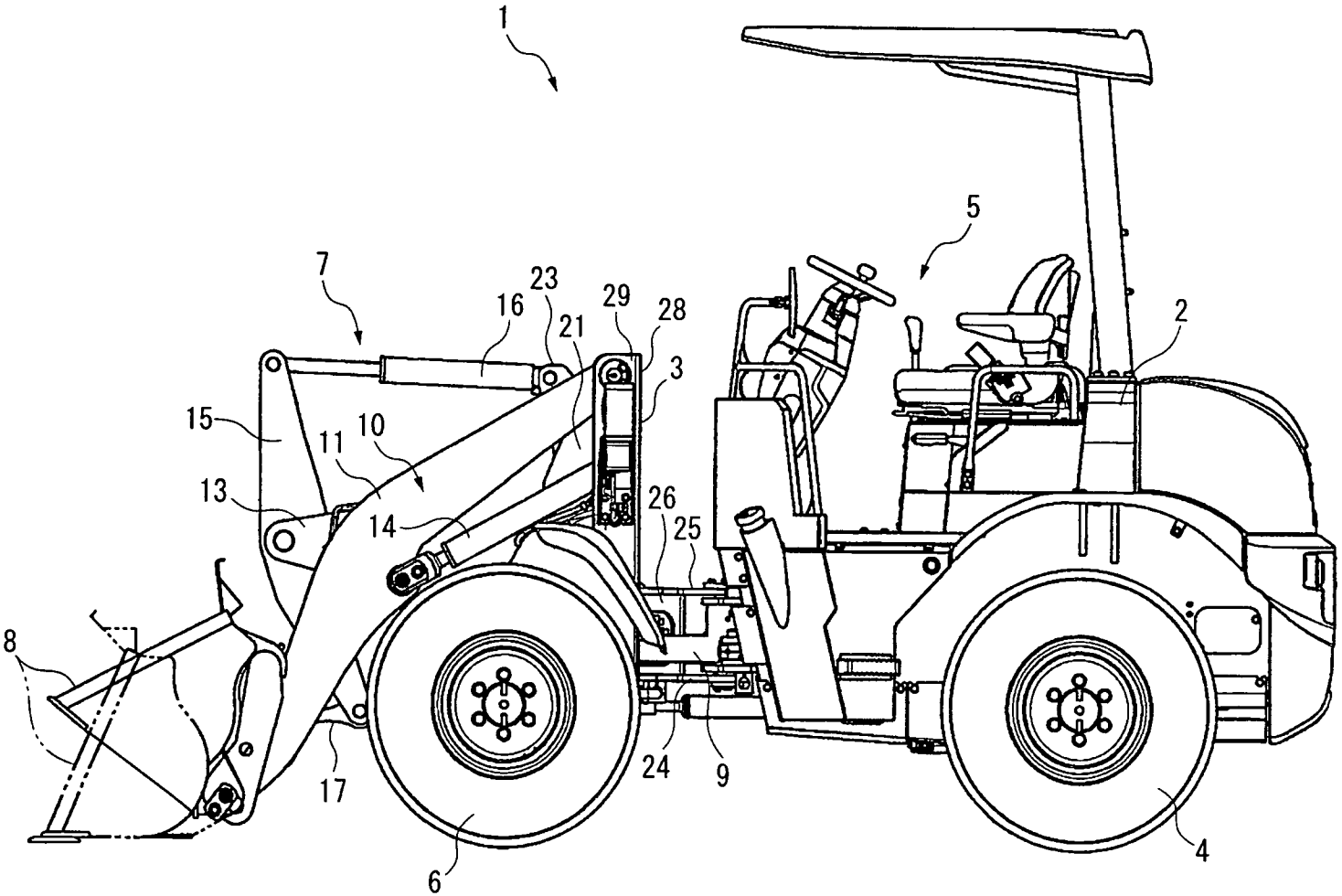
FIG. 1 is a side view showing an entire wheel loader according to an embodiment of the present invention.
Figure 2:
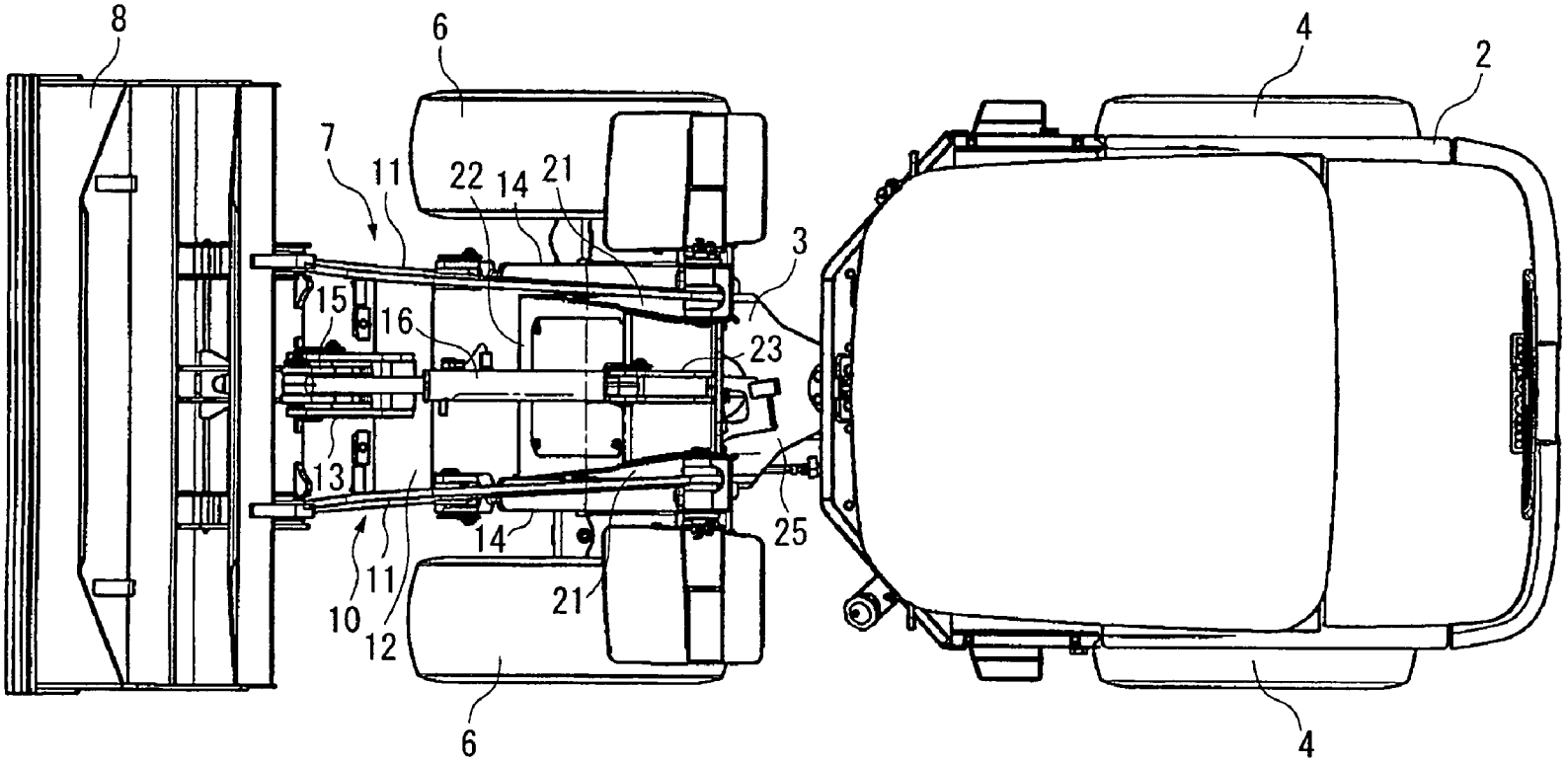
FIG. 2 is a plan view of a wheel loader 1.

An embodiment of the present invention will be described below with reference to the drawings. FIG. 1 is a side view showing an entire wheel loader 1 according to the present embodiment. FIG. 2 is a plan view of the wheel loader 1.

The wheel loader 1 in the present embodiment has an operating mass of around 2.5 t, and has a structure in which a front frame 3 is articulatably attached to a rear vehicle body 2. The rear vehicle body 2 is provided with rear wheels 4 and a driver's seat 5, and also houses a power line (not shown). The front frame 3 is provided with front wheels 6. A working equipment 7 is provided anterior to the front frame 3. A bucket 8 is attached to the distal end of the working equipment 7.

Of these, the working equipment 7 includes a bucket boom 10 that has its base end coupled to the upper side of the front frame 3 and its distal end coupled to the bucket 8. The boom 10 includes a pair of left and right side members 11, and the side members 11 are coupled to each other midway along their front-rear direction by a crossmember 12 (see FIG. 2). The upper side of the front frame 3 and the middle of each side member 11 are coupled by a boom cylinder 14. By extension/retraction of the boom cylinder 14, the boom 10 is raised and lowered, vertically moving the bucket 8.

A tilt lever 15 is rotatably supported via a bracket 13 on the crossmember 12 of the boom 10. The top side of the tilt lever 15 and the upper side of the front frame 3 are coupled by a tilt cylinder 16 while the bottom side of the tilt lever 15 and the bucket 8 are coupled by a tilt rod 17. Accordingly, the bucket 8 is tilted by the extension/retraction of the tilt cylinder 16.

As shown in FIG. 2, the side members 11 of the boom 10 are arranged to spread out as extending towards the front side (bucket 8 side), and a pair of boom cylinders 14 are arranged in parallel with respect to the front-rear direction. At the points where first ends of the boom cylinders 14 are connected to the side members 11, the boom cylinders 14 and the side members 11 are connected together so that their centerlines substantially match. Thus, the points where second ends of the boom cylinders 14 are connected to the front frame 3, when viewed from above, are positioned more externally to the left and right of the vehicle body compared to the connection positions with the side members 11.

Figure 3:
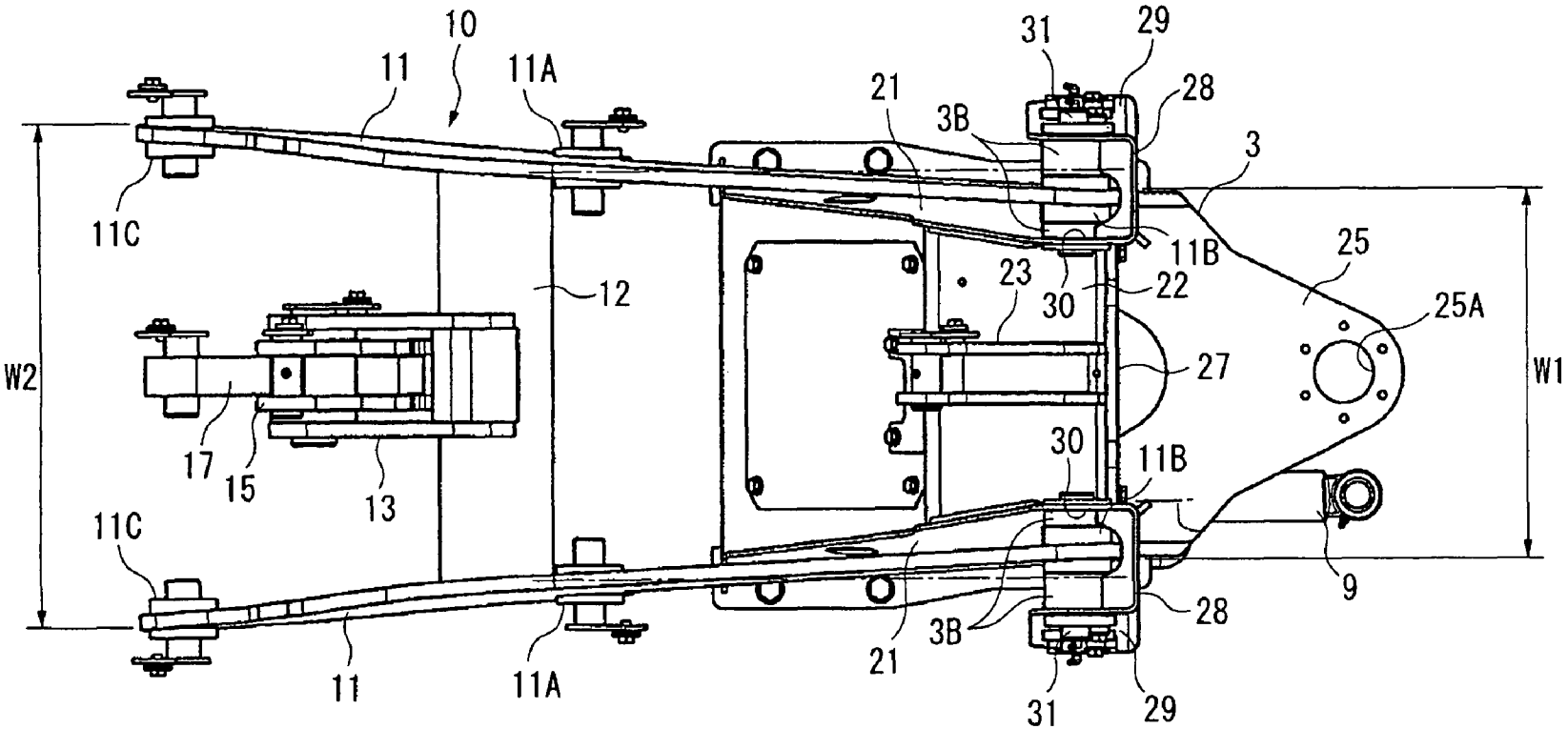
FIG. 3 is a plan view showing a front frame and a bucket boom.
Figure 4:
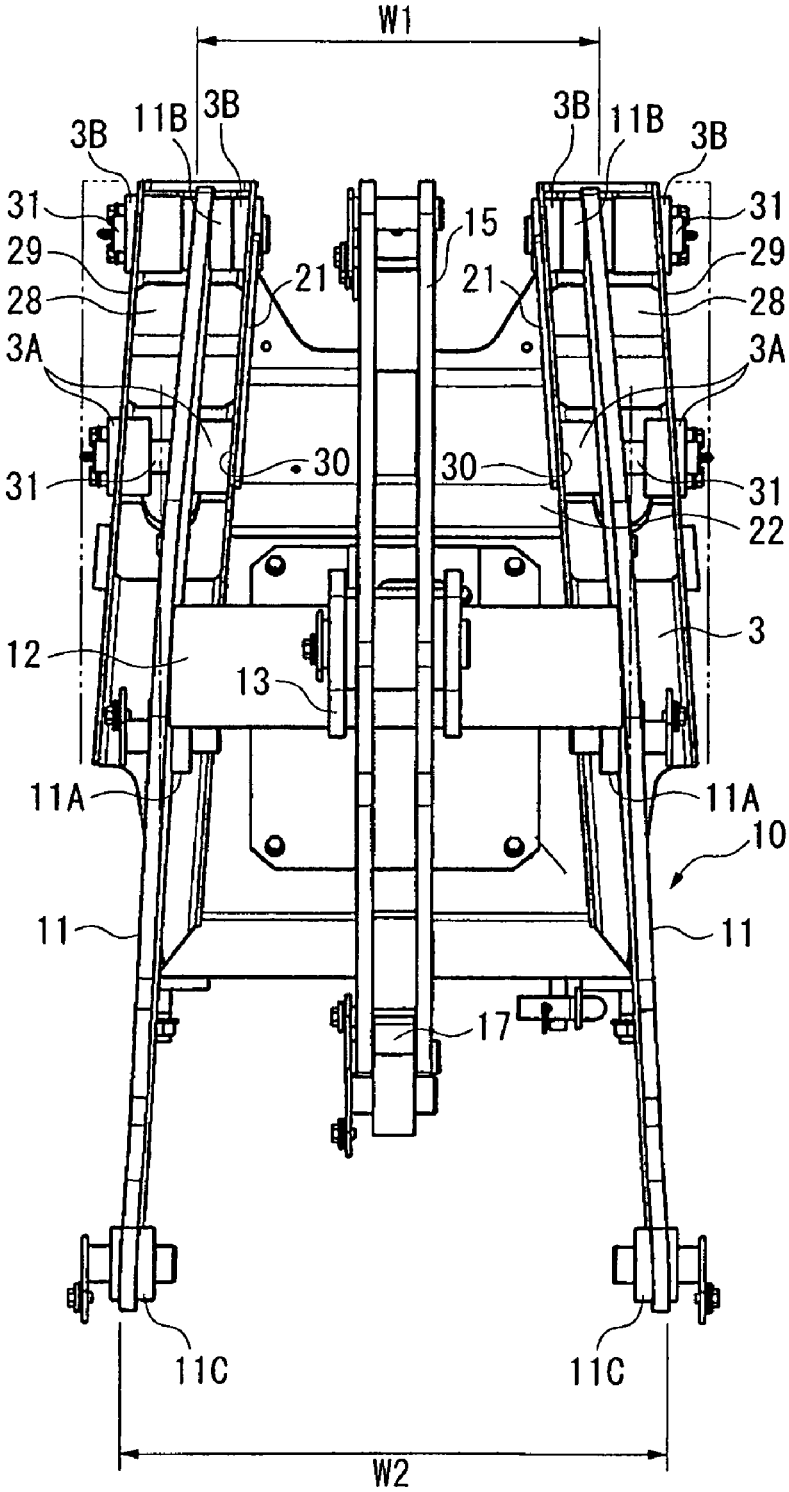
FIG. 4 is a front view showing the front frame and the bucket boom.

As shown in FIGS. 3 and 4, the side members 11 are arranged to spread out as extending towards the front side, so an interval W1 adjacent to base ends of the side members 11 is smaller than an interval W2 adjacent to distal ends of the side members 11. However, while mounting bosses 3A and 11A for attaching the boom cylinder 14 are provided on the front frame 3 and side members 11 respectively, the mount centers of the boom cylinders 14 in these mounting bosses 3A and 11A are not displaced to the left or right. The pair of boom cylinders 14 is arranged in parallel with respect to the front-rear direction (see the single-dot broken line in the drawings).

In these circumstances, a mounting boss 11A of each side member 11 is provided directly under the relevant side member 11. With this arrangement as well as an arrangement where the base ends of both side members 11 come towards the middle of the left and right directions, the mounting bosses 3A for the boom cylinders 14 are provided in the front frame 3 in positions more externally offset than mounting bosses 3B for the side members 11 located on an upper side of the mounting bosses 3A. As a result of this, the boom 10 can be raised and lowered without difficulty by the pair of boom cylinders 14 arranged in parallel.

Figure 5:
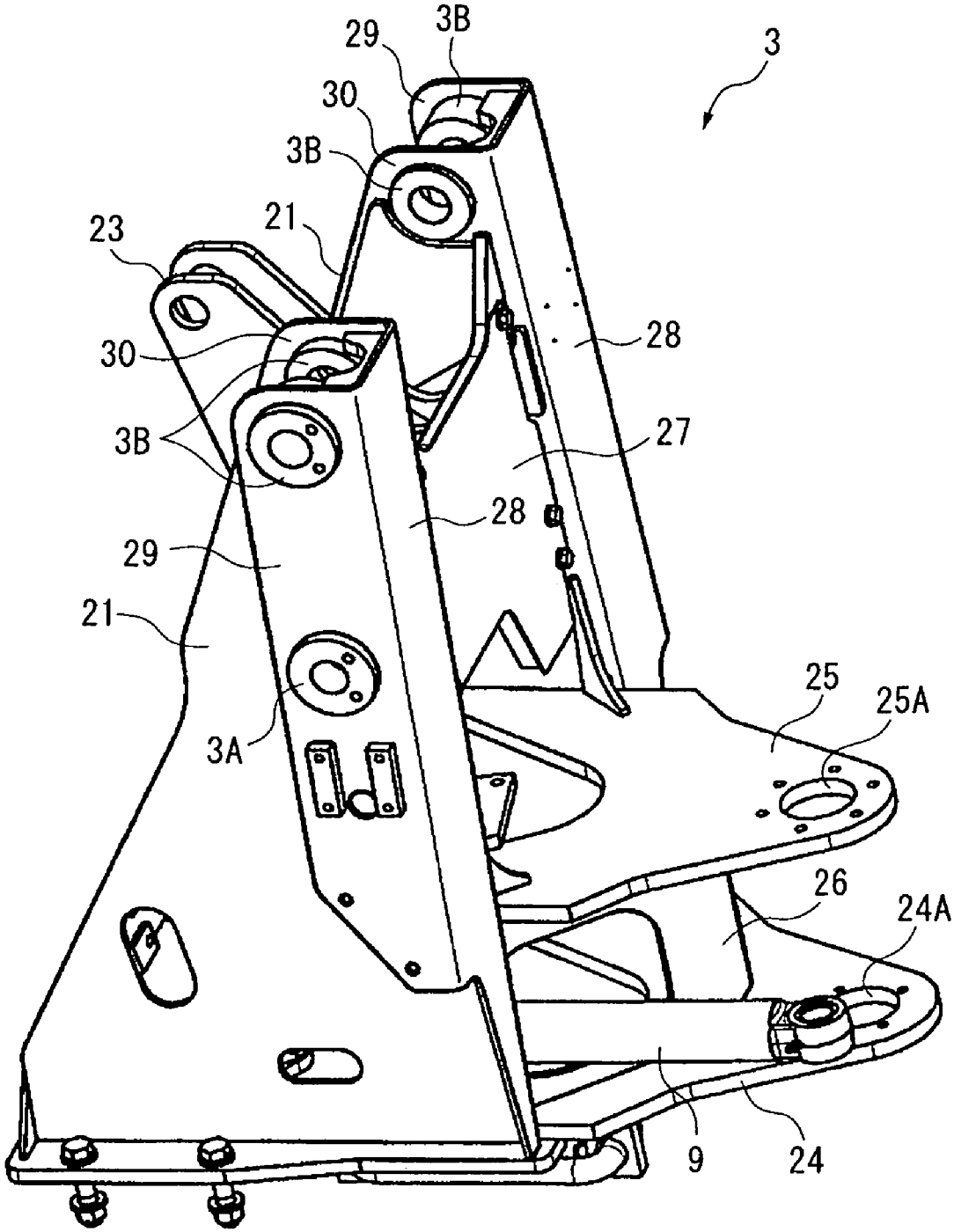
FIG. 5 is a perspective view showing the front frame.

The structure of the front frame 3 will be explained using FIG. 5, with reference to FIGS. 3 and 4. FIG. 5 is a perspective view showing the front frame.

The front frame 3 has a pair of left and right side panels 21 of a substantially triangular shape, and the area between the side panels 21 on the front side is covered by a front panel 22 (see FIGS. 3 and 4). A bracket 23 is provided on the top of this front panel 22, and the base end of the tilt cylinder 16 (see FIGS. 1 and 2) is coupled to this bracket 23.

The area between the side panels 21 in its lower region is covered by a bottom panel 24. The bottom panel 24 and an upper panel 25 arranged above the bottom panel 24 are provided with insertion holes 24A and 25A for an articulation pin (not shown). The front frame 3 and the rear vehicle body 2 are connected by this articulation pin, so that the front frame 3 is articulated around this pin. The numeral 9 in the drawings denotes an articulation cylinder On the back side of the side panels 21, the area between the bottom panel 24 and the upper panel 25 is filled with a fill-panel 26, and the further upper side of the upper panel 25 is filled with a back panel 27. With this arrangement, the front frame 3 is shaped in deformed box, and a control valve (not shown) is housed inside for controlling the supply of hydraulic fluid to each of the cylinders 9, 14 and 16.

Each of the side panels 21 of the front frame 3 is provided with a folded section 28 vertically folded to have a substantially U-shaped cross-section. The mounting bosses 3A for the boom cylinder 14 and mounting bosses 3B for the side member 11 are provided on a face section 29 that forms the outer side of the folded-back section 28 and on a face section 30 opposed to and located interior to the face section 29 such that the mounting bosses 3A and the mounting bosses 3B are vertically spaced apart from each other.

As shown in FIG. 4, the side panels 21 are inclined inward towards the middle of the left and right directions as extending in an upwards direction. With this arrangement, the face sections 29 and 30 of the folded sections 28 provided on the side panels 21 are parallel with each other, and also inclined inward towards the middle as extending in an upwards direction. Thus, the mounting bosses 3A for the boom cylinders 14 and the mounting bosses 3B for the side members 11 are offset outward and inward respectively.

Furthermore, the mounting bosses 3A and 3B are attached so that their upper sections protrude more than their lower sections with respect to the face sections 29 and 30, such that coupling pins 31 for coupling the boom cylinders 14 and side members 11 will be horizontal. Moreover, the bosses 11A, 11B and 11C located at the middle, base end, and distal end of the side members 11 are for attaching the distal ends of the boom cylinders 14, the front frame 3, and the bucket 8, respectively. As shown in FIG. 4, the bosses are attached to the side members 11 with an angle satisfying W2>W1. When the side members 11 and the front frame 3 are brought together, the pinholes of the bosses 11A, 11B and 11C are horizontal and parallel with respect each other. With this arrangement, no twisting force acts upon the side members 11, the boom cylinders 14 and the like when the side members 11 are moved vertically by the extension/retraction of the boom cylinders 14.

Accordingly, by each of the face members 29 positioned on its left and right extremities being inclined inward in the front frame 3, a field of vision from the driver's seat 5 can be ensured to be wide on both the left and right sides of the upper section of the front frame 3. In other words, the field of vision on both the left and right sides of the upper section of the front frame has been conventionally obstructed in a comparatively small wheeled loader where a driver's seat is positioned low because the side panels and folded sections have been provided perpendicularly as shown by the double-dot broken line in FIG. 4. However, according to the present embodiment, even from the driver's seat 5 positioned low, both ends of the bucket 8 can be favorably observed through both the left and right sides of the upper section of the front frame 3. Thus, forward visibility can be improved to a great extent.

Figure 6:
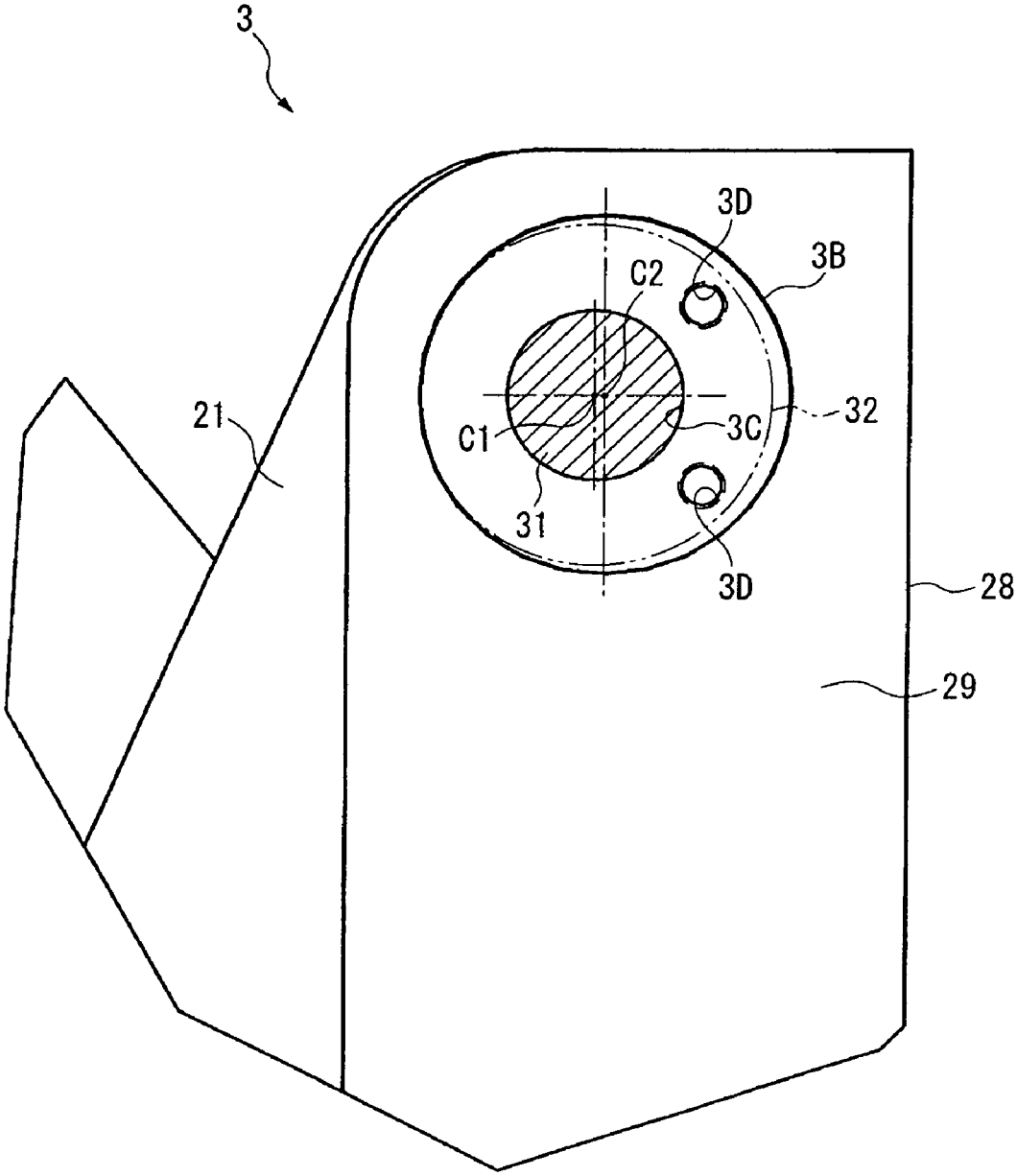
FIG. 6 is an enlarged side view showing the main parts of the front frame.

FIG. 6 shows a mounting boss 3B provided on the face section 29 on the outer side of the folded back section 28. This mounting boss 3B is provided with a through-hole 3C for insertion of a coupling pin 31 for coupling the side member 11. The axial center C1 of the through-hole 3C is set at a position de-centered forward with respect to the axial center C2 of the mounting boss 3B.

With this arrangement, the mounting boss 3B becomes thicker on the rear side of the through-hole 3C. In this thick section, bolt holes 3D for stopping the coupling pin 31 from falling out are formed. In short, the coupling pin 31 is provided with a flange 32 (shown by the double-dot broken line in the drawing), and by bolting bolts that pass through this flange into the bolt holes 3D, the coupling pin 31 can be prevented from falling out. Although not shown, the same applies for the mounting boss 3A.

Usually, the bolt holes for preventing the connection pins 31 from falling out are provided, not on the mounting bosses 3B, but on reinforcing panels attached by welding or the like on the face sections 29 on the outer sides of the folded sections 28. In such an arrangement, it is difficult to form the bolt hole diagonally in the reinforcing panel. Even if the bolt hole is to be formed perpendicularly, the folded section 28 has to be made larger so as to secure the thickness and the size required for the reinforcing panel and the necessary dimensions for the welding. Hence, only limited improvement can be made in visibility even by inclining the front frame 3 toward the upwards direction.

Accordingly, by employing the structure in FIG. 6 for preventing the coupling pins 31 from falling out, there is no need to provide a reinforcing panel, and the size of the folded sections 28 can be kept to a minimum. Thus, along with a structure in which the front frame 3 is inclined toward the upwards direction, improvement of visibility can be easily achieved.

While the best structures and methods and the like for implementing the present invention have been disclosed above, the present invention is not limited by these. In other words, while the present invention has been particularly explained and illustrated mainly in relation to a specific embodiment, a person skilled in the art could make various modifications in terms of shape, quantity or other particulars to the above described embodiment without deviating from the technical idea or an object of the present invention.

Accordingly, any descriptions of shape or quantity or the like disclosed above are given as examples to enable easy understanding of the present invention, and do not limit the present invention, so that descriptions using names of components, with any such limitations of shape or quantity or the like removed in part or whole, are what are included in the present invention.

For example, in the present embodiment, the face sections 29 and 30 of the side panels 21 are both inclined, and both in parallel, but the present invention only require that the outermost face sections be inclined. Also with this arrangement, open space can be ensured on the left and right of the upper section of the front frame, so that a favorable field of vision can be attained, and an object of the present invention can be achieved.

The invention claimed is:

1. A wheel loader, comprising:

a bucket boom comprising a pair of left and right side members;

a front frame to which base ends of the pair of side members are coupled, the front frame comprising a pair of left and right side panels; and a pair of boom cylinders, a base end of each of which is coupled to the front frame and a distal end of each of which is coupled to a respective one of the side members, wherein:

an interval between the pair of side members at the base ends thereof is smaller than an interval at distal ends thereof, a face section that inclines towards a middle as extending in an upwards direction is provided on each of the left and right side panels of the front frame, a mounting boss to which the base end of a respective one of the boom cylinders is attached is provided on a lower side of each face section, a mounting boss to which the base end of a respective one of the side members is attached is provided on an upper side of each face section, and the side panels are wholly inclined in the same direction as the respective face sections.

2. The wheel loader according to claim 1, wherein:

a folded section that is vertically folded to have a substantially U-shaped cross-section is provided on each of the side panels, each face section comprises a first face section which forms an outer side of the folded section and a second face section opposed to and located interior to the first face section, and the mounting boss for each of the boom cylinders and the mounting boss for each of the side members are provided on each of the respective first face sections and the respective second face sections such that the mounting bosses are vertically spaced apart from each other.

3. The wheel loader according to claim 1, wherein:

at least one of the mounting bosses is provided with a through-hole that allows a coupling pin to pass through, the coupling pin including a flange, an axial center of the through-hole is de-centered with respect to an axial center of the mounting boss, and a bolt hole into which a bolt for fastening the coupling pin via the flange is bolted is provided in a thick section of the mounting boss, the thick section being provided by the de-centering.

4. The wheel loader according to claim 2, wherein:

at least one of the mounting bosses is provided with a through-hole that allows a coupling pin to pass through, the coupling pin including a flange, an axial center of the through-hole is de-centered with respect to an axial center of the mounting boss, and a bolt hole into which a bolt for fastening the coupling pin via the flange is bolted is provided in a thick section of the mounting boss, the thick section being provided by the de-centering.

* * * * *